US005909934A

United States Patent [19]

McGraw

[11] Patent Number: 5,909,934

[45] Date of Patent: Jun. 8, 1999

[54] COMPUTER DESK

[76] Inventor: Jon McGraw, 2804 W. Pawnee, Apt. 244, Wichita, Kans. 67213

[21] Appl. No.: 09/122,156

[22] Filed: Jul. 24, 1998

[51] Int. Cl.[6] ..... A47B 81/06

[52] U.S. Cl. ..... 312/223.3; 297/188.21

[58] Field of Search ..... 312/223.2, 223.3, 312/235.9, 235.2, 223.1; 297/188.21, 174, 170

[56] References Cited

U.S. PATENT DOCUMENTS

| | | | |
|---|---|---|---|
| 2,375,696 | 5/1945 | Shick | 297/188.21 |
| 4,779,922 | 10/1988 | Cooper | 297/188.21 |
| 4,880,270 | 11/1989 | Cooper | 297/188.21 |
| 5,275,482 | 1/1994 | Grant | 297/174 |
| 5,573,320 | 11/1996 | Shearer | 312/223.1 |

*Primary Examiner*—Peter M. Cuomo
*Assistant Examiner*—Gerald A. Anderson
*Attorney, Agent, or Firm*—Kenneth Jack

[57] ABSTRACT

A computer desk consisting of an oblongated base; a chair having a seat, and a forward edge; a chair attaching column interconnecting the chair and the oblongated base so that the chair overlies the rearward end of the oblongated base; a support column having a hollow interior space fitted for receiving and retaining a personal computer central processing unit having a tower configuration; slide ridges and slide channels slidably attaching the support column to the oblongated base so that the support column extends upwardly from the upper surface of the oblongated base, and so that the support column may be slidably positioned along the longitudinal axis of the oblongated base; and a cantilevered desk top fixedly attached to or homogeneously fused with the upper end of the support column.

16 Claims, 4 Drawing Sheets

COMPUTER DESK

FIELD OF THE INVENTION

This invention relates to furniture adapted for efficient utilization of computer equipment and accessories.

BACKGROUND OF THE INVENTION

Personal computing systems commonly consist of a "tower" configuration central processing unit, a monitor, a keyboard, speakers, a plurality of disk drives, and a dot matrix, ink jet, or laser printer. Such computer components are commonly assembled upon a common desktop for utilization by a computer operator seated at a common desk chair. A drawback of such utilization of a common desk and chair is that it does not allow ergonomic positioning of the operator's body, arms and legs. Another drawback or deficiency of such use of furniture is that it requires wasteful and inefficient arm and hand motions in manipulation of the keyboard, the disk drives, monitor controls, and the printer controls.

The instant inventive computer desk solves such problems by providing a desk and chair combination, a major support column of the desk being adapted for receiving and retaining a computer central processing unit having a tower configuration; the desk and central processing unit column being slidably positionable with respect to the chair along an oblongated base. Through utilization of the instant inventive computer desk, ergonomic advantages are obtained and efficiencies in hand and arm motions are obtained.

PRIOR ART PATENTS

U.S. Pat. No. 371,168 issued Oct. 11, 1887, to Boss discloses a combination seat and desk stand.

U.S. Pat. No. 784,604 issued Mar. 14, 1905, to Wall discloses a combination chair and table.

U.S. Pat. No. D207,262 issued Mar. 28, 1967, to Maurer discloses a combination chair and desk.

U.S. Pat. No. 3,910,659 issued Oct. 7, 1975, to Peterson discloses a cantilevered table top.

U.S. Pat. No. 4,779,922 issued Oct. 25, 1988, to Cooper discloses a chair having computer monitor and computer keyboard supporting and positioning means.

U.S. Pat. No. 5,056,864 issued Oct. 15, 1991, to Cooper discloses a chair having computer monitor and computer keyboard supporting and positioning means.

U.S. Pat. No. 4,880,270 issued Oct. 14, 1989, to Cooper discloses a chair having computer monitor and computer keyboard supporting and positioning means.

U.S. Pat. No. 4,915,450 issued Apr. 10, 1990, to Cooper discloses a chair having computer monitor and computer keyboard supporting and positioning means.

None of the disclosed patents teach, disclose or describe the novel, inventive, useful and unique elements and features of the present inventive computer desk.

BRIEF SUMMARY OF THE INVENTION

A preferred embodiment of the present inventive computer desk comprises three major structural elements, they being a support column having a cantilevered desk top extending laterally therefrom, an oblongated base, and a chair.

The support column preferably has a power strip/electric surge suppressor supporting subfloor, such subfloor being substantially rectangular in shape, such subfloor having a width slightly wider than the width of a common personal computer central processing unit having a tower configuration, and having a depth slightly longer than the depth of such a central processing unit. Forward, rear, left, and right side walls are preferably fixedly attached to or homogeneously fused with the four edges of the rectangular subfloor, such walls extending upwardly therefrom, forming an enclosure. Preferably, the distance between the interior surfaces of the side walls is at least eight inches to accommodate the width of most common personal computer central processing units having a tower configuration. Also preferably, the distance between the interior surfaces of the forward and rearward walls of the support column is at least twenty inches to accommodate the depth of such a central processing unit along with cables and power cords extending from its cable ports.

Preferably, a central processing unit supporting floor spans between and further interconnects the side walls and forward and rear walls, the lower surface of the central processing unit supporting floor being positioned approximately three inches above the upper surface of the subfloor, allowing a power strip/electric surge suppressor to be positioned and stored in the space defined by the side walls, the two floors, and the forward and rear walls. Preferably, the power strip supporting floor is apertured allowing downward extension of the power cord of the power strip/electric surge suppressor. Also preferably, the central processing unit supporting floor is apertured allowing downward insertion therethrough of the power strip/electric surge suppressor, and allowing downward extension therethrough of power cords and plugs extending from central processing unit and from the computer monitor. Preferably, both of such apertures are positioned toward the forward end of the support column.

The side walls and forward and rear walls of the support column preferably extend upwardly from the upper surface of the central processing unit supporting floor, such walls defining a hollow central processing unit containing space fitted for receiving and supporting a personal computer central processing unit having a tower configuration. Preferably, the rearward wall has a central processing unit receiving aperture for insertion of the central processing unit, and preferably the side walls have a multiplicity of air vent apertures allowing air cooling of the central processing unit.

A hollow cantilevered desktop preferably extends laterally, either rightwardly or leftwardly from the upper ends of the walls of the support column. Where, for example, the cantilevered desktop extends leftwardly from the support column an upper wall of the desktop is fixedly attached to or homogeneously fused with the upper edge of the right side wall of the support column, and a lower wall of the cantilevered desktop is either fixedly attached to or homogeneously fused with the upper edge of the left side wall of the support column. A rear wall, a forward wall, and a side wall preferably interconnect the upper and lower walls of the cantilevered desktop, forming a hollow interior space. Preferably, the undersurface of the cantilevered desktop is upwardly recessed, such recess being fitted for slidable and extendable mounting of a computer keyboard. Such keyboard is preferably mounted upon a rectangular shelf, such shelf being extendable and retractable upon extension tracks. Preferably, the forward wall of such recess is apertured for extension therethrough of a keyboard cable into the hollow interior space of the cantilevered desktop. Also preferably, the forward wall of the cantilevered desktop is apertured for extension therethrough of cables extending from the computer monitor resting thereon, such cables extending into the hollow interior space of the cantilevered desktop.

The hollow interior space of the cantilevered desktop preferably is continuous with the hollow interior space within the support column, such continuity allowing cables extending from the computer monitor and extending from a keyboard mounted beneath the cantilevered desktop to extend through the cantilevered desktop's hollow interior space, and thence into the hollow interior space of the support column for attachment to cable receiving ports on the back side of the central processing unit.

Preferably, the lower surface of the support column has a pair of parallel teflon coated slide ridges extending downwardly therefrom for slidable engagement with the computer desk's base. The base of the computer desk preferably comprises an oblong track having a pair of teflon coated slide channels fitted for slidably receiving the slide ridges of the support column. Preferably, the slide ridges in combination with the slide channels have a "tongue and groove" configuration allowing the support column to both interlock with the base, and slide along the length of the base.

A swiveling and reclining ergonomic chair or seat preferably is mounted upon the rearward end of the base by means of a swivel column, such chair being rotatable from a first position allowing a computer operator to easily seat himself upon or arise from the chair, to a second position wherein the cantilevered desktop overlies the computer operator's lap. Preferably, reclining motion of the chair is dampened by gas charged cylinders which slidably house flow through pistons and piston rods. Swiveling motion of the chair is preferably facilitated by a pair of nesting cylinders which form a chair support column, such column extending downwardly from the lower surface of the chair. Preferably, the back of the chair is lengthened, providing head, neck and shoulder support; and preferably, the support surface of the chair seat extends at an angle downwardly providing foot and lower leg support.

Preferably, the support column, the cantilevered desktop, the base, and the chair are each fabricated from and composed of composite laminates consisting of layers of fiberglass or graphite fibers and polymer resins.

The combination of the cantilevered desktop, the support column, the base, and the chair provides an economically constructed and durable computer desk which provides easy access to all common computer components and which provides comfortable body positioning.

Accordingly, it is an object of the present inventive desk chair to provide an ergonomic assembly including a cantilevered desk and desk chair interconnected by a base, such combination providing central processing unit containing means, and providing adjustable positioning of computer components in relation to the position of a seated or reclining computer operator.

Other and further objects, benefits and advantages of the present inventive computer desk will become known to those skilled in the art upon review of the Detailed Description which follows, and upon review of the appended drawings.

DETAILED DESCRIPTION OF THE PREFERRED EMBODIMENT

Figure 1:
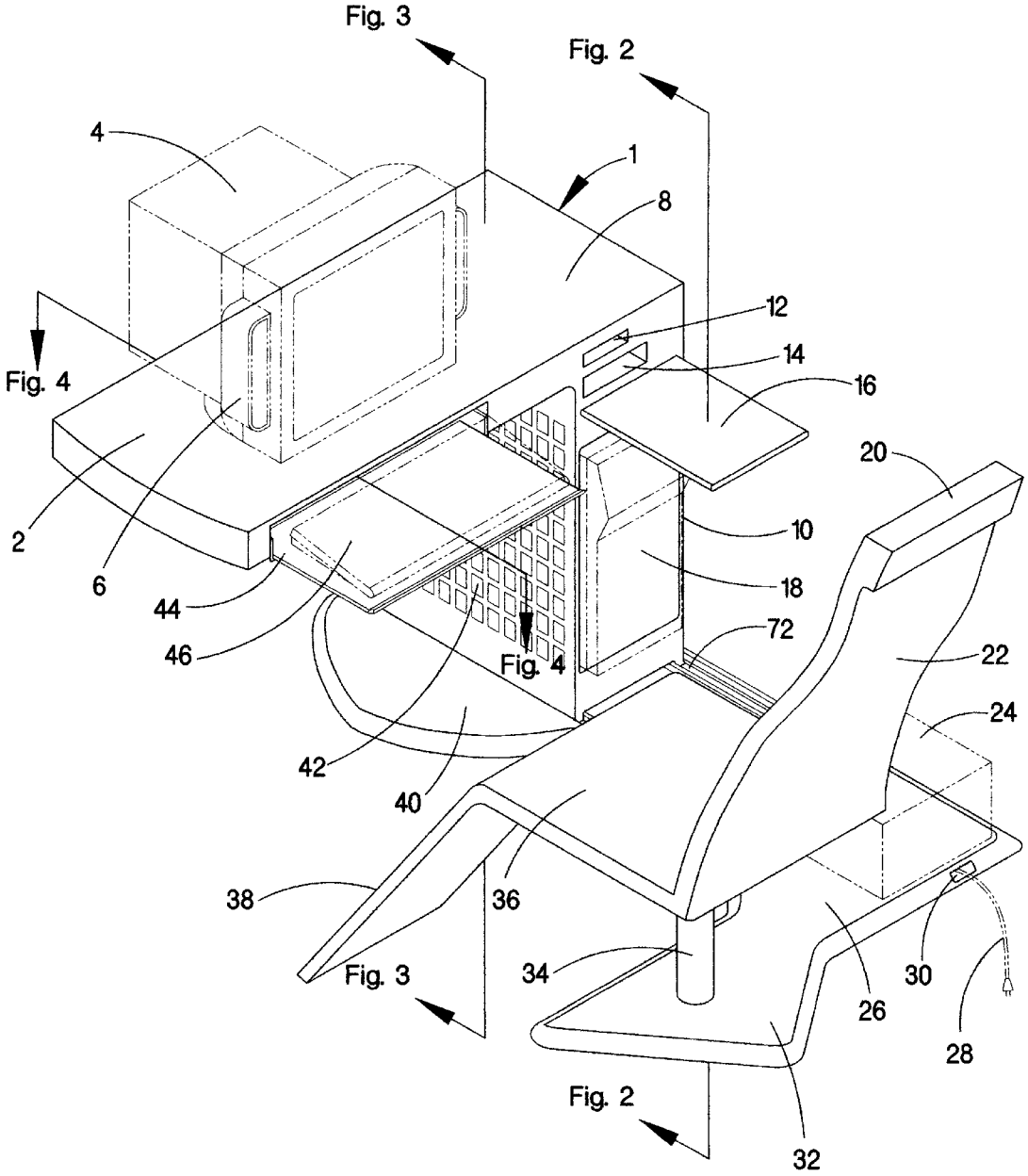
FIG. 1 is an isometric view of the present inventive computer desk.

Referring now to the drawings, and in particular to FIG. 1, the present inventive computer desk is referred to generally by Drawing Element 1. The computer desk has a chair 22 and a cantilevered desktop 2 which is supported by a support column 10, the cantilevered desktop 2, the support column 10, and the chair 22 all being commonly supported and positioned by an oblongated base 26.

The chair 22 has a seat 36, a back and head rest 20 extending upwardly from the rearward edge of the seat 36 and a foot and leg support 38 extending downwardly from the forward edge of the seat 36. A swivel support column 34 interconnects the lower surface of the seat 36 with the upper surface of the base 26, such interconnection preferably allowing the chair 22 to simultaneous rotate in a horizontal plane and to recline in a vertical plane. The swivel support column 34 preferably comprises a pair of nesting cylinders which facilitate such rotary motion; and preferably the reclining motion is provided by a pin and device joint mounted upon the upper end of the swivel support column (not shown), the reclining motion preferably being dampened by a pair of gas charged cylinders which slidably extend and retract a pair of flow through pistons and piston rods (not shown). The lower end of the swivel support column 34 is preferably fixedly attached to a chair support extension 32 of the base 26, such chair support extension 32 allowing the chair 22 to be aligned behind the cantilevered desktop 2. Preferably, the chair 22 is composed of a graphite laminate composite, and preferably the swivel support column is composed of tubular steel.

Figure 2:
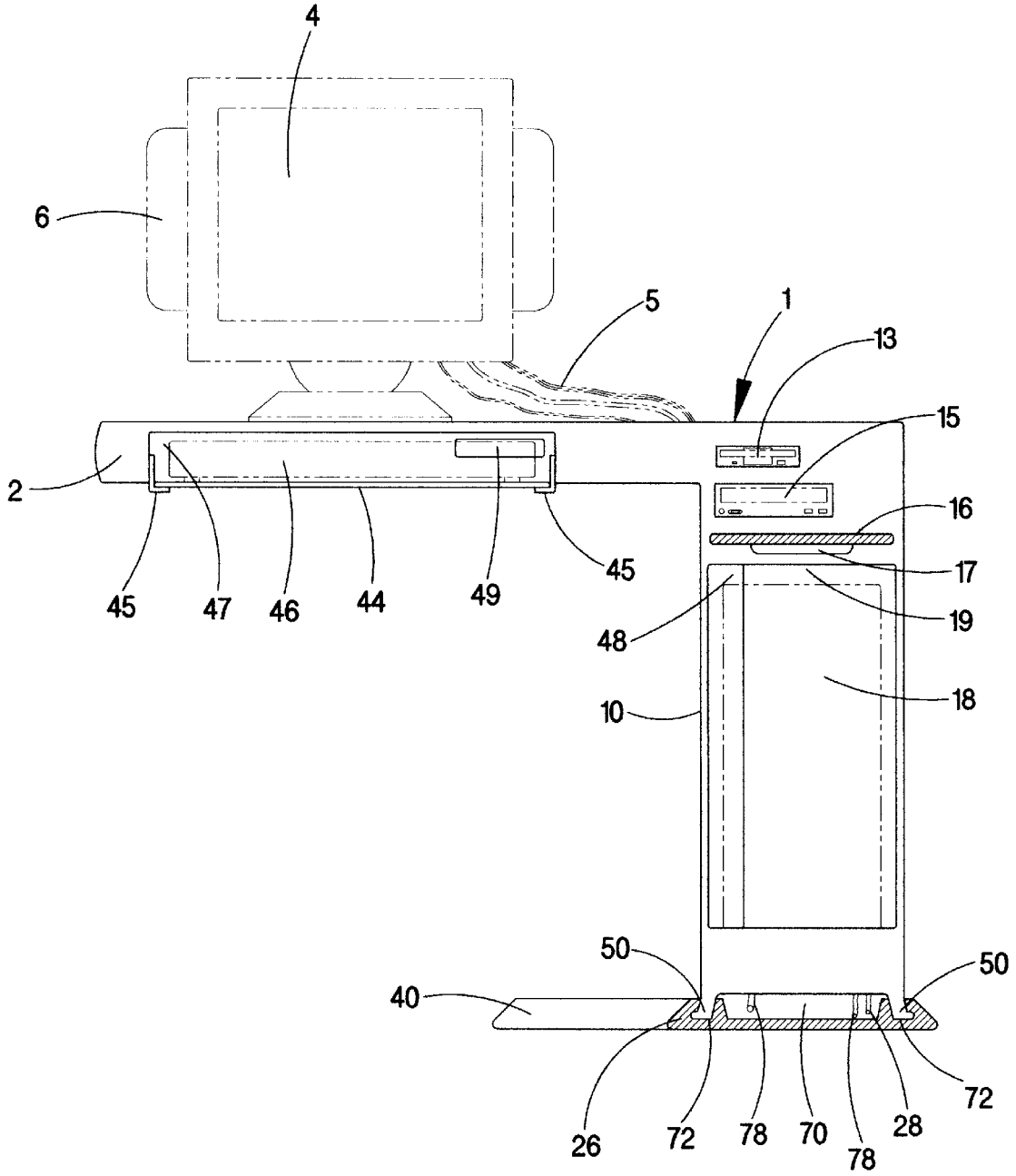
FIG. 2 is a lateral sectional view of the desk depicted in FIG. 1, the view additionally including a pair of disk drives depicted in ghost.
Figure 4:
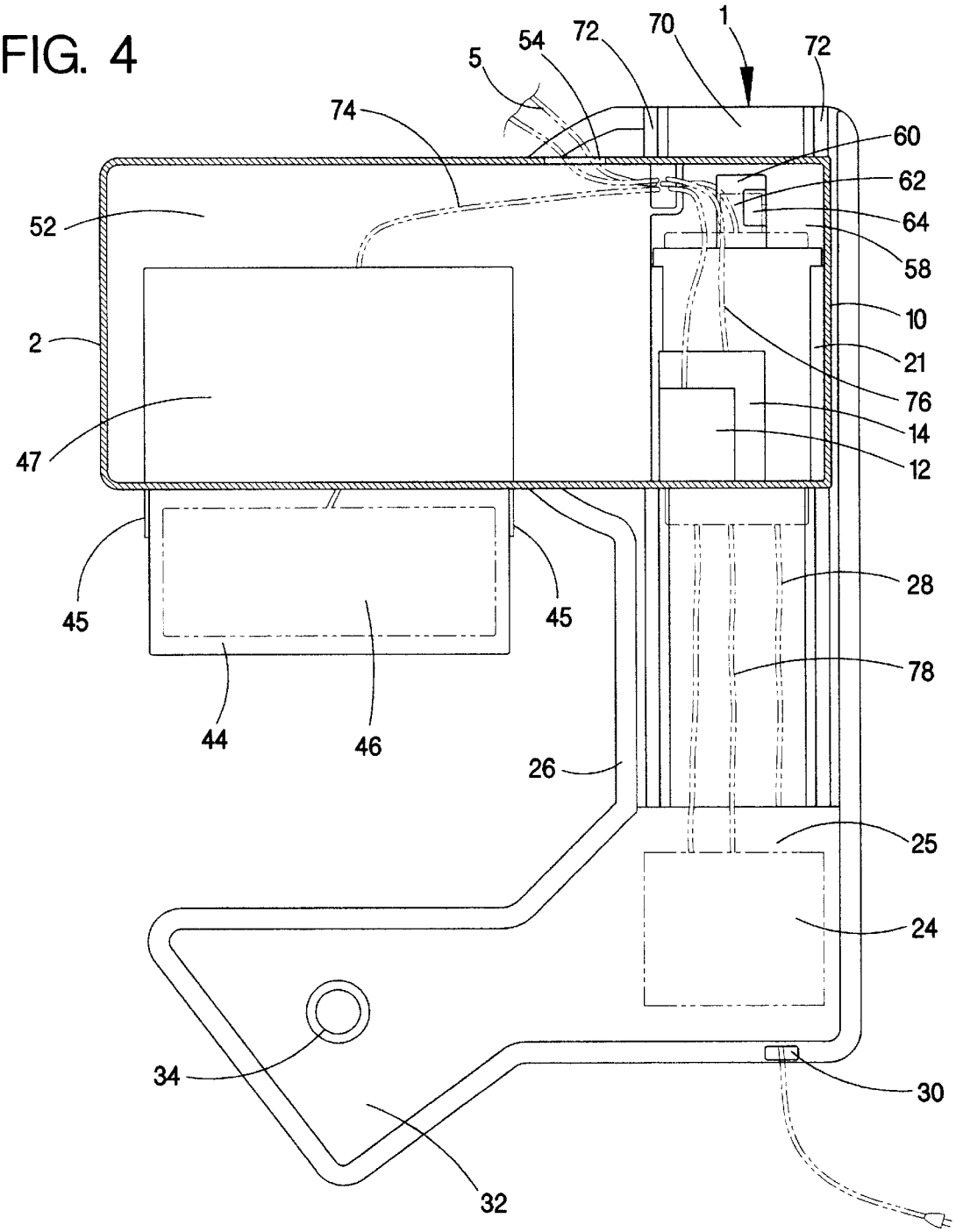
FIG. 4 is an horizontal sectional view of the computer desk depicted in FIG. 1, the chair being removed and absent from the view.

Referring simultaneously to FIGS. 1 and 2, the oblongated base 26 extends rightwardly from the swivel support column 34 to form a printer support surface 25 for supporting a dot matrix, ink jet, or laser printer 24. From the printer support surface 25, the oblongated base 26 extends forwardly to form a pair of parallel slide channels 72 which border a cable routing channel 70. Preferably, the cable routing channel 70 or a narrowed portion thereof extends rearwardly beneath the printer support surface 25 allowing a power strip cable 28 to extend thereunder to emerge from a power cord aperture 30. Referring simultaneously to FIGS. 2 and 4, slide ridges 50 which extend downwardly from the lower surface of the support column 10 slidably interlock with the slide channels 72 in a "tongue and groove" configuration allowing the support column 10 to both be affixed to the oblongated base 26 and to slide alternately rearwardly and forwardly along the slide channels 72 for selective positioning of the cantilevered desktop 2 with respect to the chair 22. Preferably, the forward end of the oblongated base 26 has a laterally extending semi-circular base stabilization extension 40, such base stabilization extension preventing the support column 10 and the cantilevered desktop 2 from tilting leftwardly. Preferably, the oblongated base 26 is composed of a molded lamina composite of fiberglass and polymer resin, such construction providing cost economy, lightness, and structural strength and durability.

Figure 3:
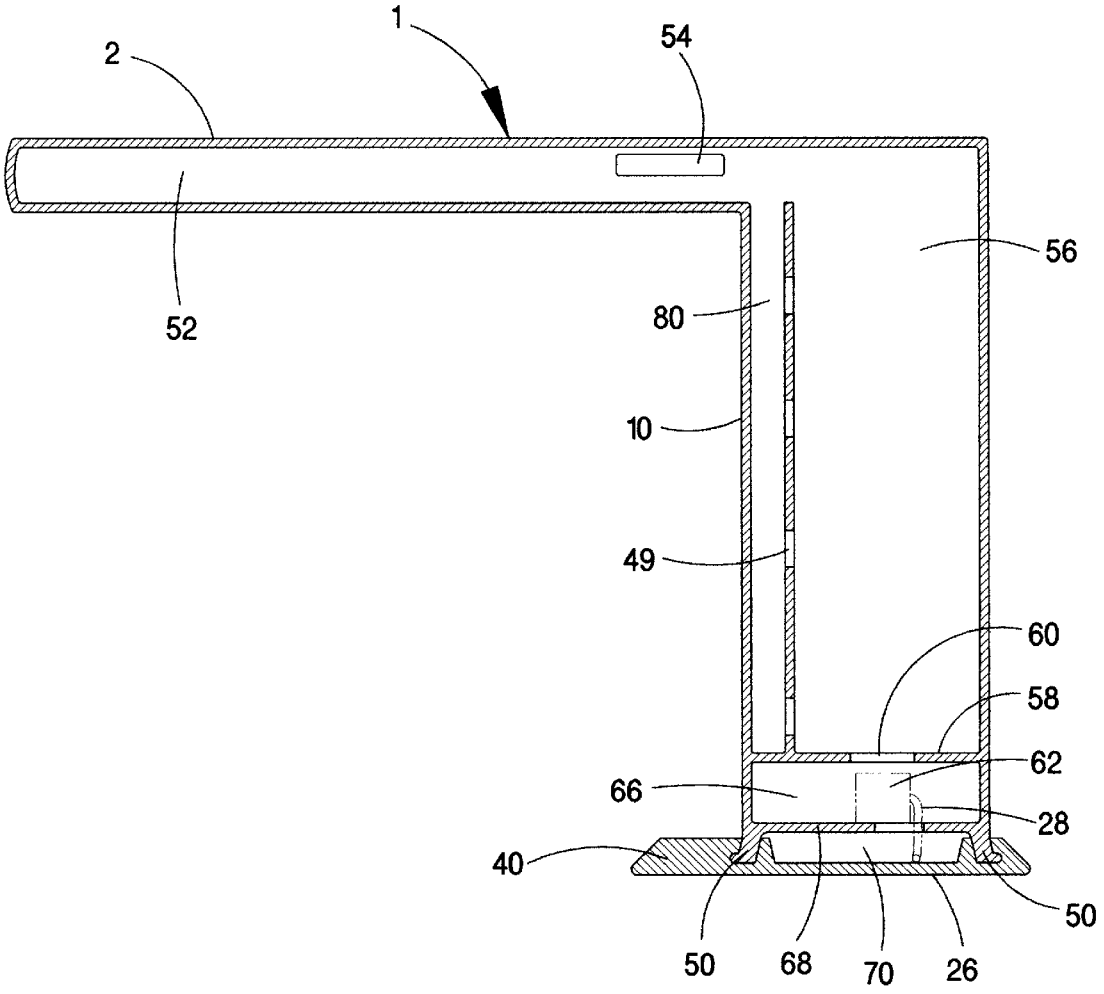
FIG. 3 is a second lateral sectional view of the computer desk depicted in FIG. 1, the view omitting depiction of cables shown in ghost in FIG. 2.

Referring to FIG. 3, the support column 10 preferably comprises a power strip support floor 68, such floor spanning between and interconnecting the lower ends of the side walls of the support column 10. The power strip floor 68 preferably retains and supports a power strip electric surge suppressor 62. The power cord 28 of such power strip preferably extends downwardly through a cable aperture 64, and thence into and along the cable routing channel 70. A central processing unit supporting floor 58 preferably spans between the side walls of the support column 10 at an elevation approximately three inches above the power strip support floor 68; the central processing unit supporting floor 58 in combination with the power strip supporting floor 68 defining a hollow power strip containing space 66. Preferably, the power strip 62 is inserted into the power strip containing space 66 through a power strip aperture 60 extending through the central processing unit supporting floor 58.

Referring simultaneously to FIGS. 1, 2 and 3, the rear wall of the support column 10 preferably has a central processing unit receiving aperture 19 therethrough, such aperture allowing a personal computer central processing unit 18 having a tower configuration to be inserted therethrough into the hollow interior space 56 of the support column 10. Preferably, the power cord of the central processing unit 18 extends downwardly through the power strip aperture 60 to be plugged into the power strip 62.

Referring simultaneously to FIGS. 2 and 3, the cantilevered desktop 2 extends leftwardly from the upper end of the support column 10, the cantilevered desktop 2 having a hollow interior space 52 which is continuous with the hollow interior space 56 of the support column 10. Preferably, the cantilevered desktop 2 has a substantially rectangular keyboard mounting recess 47 extending into its undersurface, the recess 47 having a computer keyboard 46 extendably and retractably mounted thereunder by means of a keyboard extension tray 44, which is telescopingly and retractably mounted within the keyboard recess 47 by means of a pair of keyboard shelf extension tracks 45. Preferably, the forward wall of the keyboard recess 47 has a keyboard cable aperture 49 extending therethrough. Referring simultaneously to FIGS. 2 and 4, the keyboard cable aperture 49 allows a keyboard cable 74 to extend therethrough for passage through the hollow interior space 52 of the cantilevered desktop 2.

Referring simultaneously to FIGS. 2 and 4, the forward facing wall of the cantilevered desktop 2 preferably has a monitor cable aperture 54, such aperture allowing monitor cables and speaker cables 5 extending from a monitor 4 and speakers 6 to extend into and pass through the hollow interior space 52 of the cantilevered desktop 2.

Referring simultaneously to FIGS. 1, 2, and 4, a retractable shelf 16 is preferably slidably mounted within the support column 10 by means of pair of slide tracks 21, the rear facing wall of the support column 10 having a finger insertion recess 17 allowing the fingers of a computer operator's hand to alternately retract and extend the retractable shelf 16 from the support column 10. Such retractable shelf 16 is preferably utilized as a temporary storage surface for three and one-half inch floppy disks or CD rom disks, such disks being utilized within a three and one-half inch floppy disk drive 13 or a CD rom drive 15. Referring simultaneously to FIGS. 1, 2 and 4, the CD rom drive 15 and the three and one-half inch floppy disk drive 13 are preferably mounted within and supported by a three and one-half inch floppy disk drive receiving bay 12 and a CD rom drive receiving bay 14. Such bays 12 and 14 may alternately be positioned to extend forwardly from the rear wall of the cantilevered desktop 2 rather from the rearward facing wall of the support column 10, and such bays may be alternately configured to receive other types of disk drives.

Referring simultaneously to FIGS. 2, 3, and 4, a cable routing channel 48 preferably extends vertically along the interior surfaces of the left side wall and forward wall of the support column 10. Monitor and speaker cables 5 preferably extend through the monitor cable aperture 54, through the hollow interior space of the cantilevered desktop 52, downward through the hollow space 80 of the cable routing channel 48, and thence rightward through a cable aperture 49 for attachment to cable ports (not shown) on the back side of the central processing unit 18. Disk drive cables 76 similarly preferably extend downwardly through the hollow space 80 and rightwardly through a cable aperture 49 for attachment to the cable ports of the central processing unit 18. Printer cables 78 preferably extend forwardly from the printer 24 along the cable channel 70 to extend upwardly through the cable aperture 64, and through the power strip insertion aperture 60 for attachment to a printer port (not shown) on the back side of the central processing unit 18. Power cords of components such as the monitor 4 and the printer 24 may alternately be routed to extend to power ports on the back side of the central processing unit 18, or through apertures 64 and 60 to plug into the power strip 62.

Preferably, the support column 10 and the cantilevered desktop 2 are composed of a molded lamina of fiberglass fibers and polymer resin for cost economy, lightness in construction, and structural durability and strength.

In operation of the computer desk 1, referring to FIG. 1, a computer operator approaches the chair 22 and rotates the chair leftwardly so that the chair's foot and leg support 38 extends leftwardly from under the cantilevered desktop 2. The operator then seats himself or herself upon the seat 38 and counter-rotates the chair 22 so that the chair faces forwardly toward the cantilevered desktop 2. Referring simultaneously to FIGS. 2 and 4, the slide channel 72 and slide ridges 50 preferably are coated with low friction teflon. Referring to FIG. 1, such low friction coating allows the operator to grasp the forward edge of the cantilevered desktop 2 to pull the desktop and support column 10 rearwardly to a comfortable position over the operator's lap. With a computer operator so positioned upon the seat 38, the printer 24, the central processing unit 18, the retractable shelf 16, the disk drive bays 12 and 14, a mouse pad area 8, the keyboard 46, the monitor 4, and the speakers 6 are all positioned within easy reach of the operator's hands. Through such slidable positioning of the support column 10 and the cantilevered desktop 2, the computer operator may recline the chair 22 rearwardly and continue to maintain all components and features of the computer system within easy reach.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A computer desk comprising:

(A) an oblongated base, the oblongated base having an upper surface, a lower surface, a forward end, a rearward end, and having a longitudinal axis extending from the forward end to the rearward end;

(B) a chair having a lower surface and a seat, the seat having a forward edge;

(C) chair attaching means interconnecting the chair and the oblongated base so that the chair overlies the rearward end of the oblongated base;

(D) a support column having an upper end, a lower end, a forward end, a rearward end, and having a first hollow interior space, the first hollow interior space being fitted for receiving and retaining a personal computer central processing unit having a tower configuration;

(E) column mounting means slidably attaching the support column to the oblongated base so that the support column extends upwardly from the upper surface of the oblongated base, and so that the support column may be slidably positioned along the longitudinal axis of the oblongated base; and, (F) a cantilevered desk top fixedly attached to or homogeneously fused with the upper end of the support column, the cantilevered desktop having a forward end.

2. The computer desk of claim 1 wherein the chair comprises leg support means fixedly attached to or homogeneously fused with the forward edge of the seat.

3. The computer desk of claim 1 wherein the chair attaching means further interconnects the chair and the oblongated base so that the chair may rotate in a substantially horizontal plane.

4. The computer desk of claim 1 wherein the support column comprises a rearwardly facing wall having a processing unit insertion aperture therethrough, the processing unit insertion aperture providing access to the first hollow interior space, the procession unit insertion aperture being fitted for passage therethrough of the personal computer central processing unit having a tower configuration.

5. The computer desk of claim 1 wherein the column mounting means comprises a left slide channel and a right slide channel, the left and right slide channels being substantially parallel with each other, and being substantially parallel with the longitudinal axis of the oblongated base.

6. The computer desk of claim 1 wherein the cantilevered desk top comprises and upper wall, a lower wall, a forward wall, a rearward wall, a side wall, and a second hollow interior space.

7. The computer desk of claim 4 wherein the support column further comprises a left side wall, a right side wall, a power strip supporting floor spanning between and interconnecting the left and right side walls, and a central processing unit supporting floor spanning between and further interconnecting the left and right side walls, the central processing unit supporting floor being positioned so that it overlies the power strip supporting floor; and wherein the support column further comprises a third hollow interior space above the power strip supporting floor and below the central processing unit supporting floor.

8. The computer desk of claim 3 wherein the chair attaching means comprises a first cylinder having an upper end and a lower end, the lower end of the first cylinder being fixedly attached to the oblongated base, and a second cylinder having an upper end and a lower end, the second cylinder having a lower opening fitted for rotatable mounting over the upper end of the first cylinder, the second cylinder being rotatably mounted over the upper end of the first cylinder, the upper end of the second cylinder being fixedly attached to the lower surface of the chair.

9. The computer desk of claim 5 wherein the column mounting means further comprises a left slide ridge and a right slide ridge, the left and right slide ridges extending from the lower end of the support column, the left and right slide ridges being fitted for slidable mounting within the left and right slide channels.

10. The computer desk of claim 6 further comprising computer keyboard positioning means fixedly attached to the cantilevered desk top, the computer keyboard positioning means being capable of alternately extending and retracting a computer keyboard.

11. The computer desk of claim 1 further comprising disk drive mounting means fixedly attached to or homogeneously fused with the rearward end of the support column.

12. The computer desk of claim 1 further comprising disk drive mounting means fixedly attached to or homogeneously fused with the rearward end of the cantilevered desk top.

13. The computer desk of claim 11 further comprising a cable routing channel extending through the first hollow interior space.

14. The computer desk of claim 12 further comprising a cable routing channel extending through the first hollow interior space.

15. The computer desk of claim 13 further comprising printer supporting means fixedly attached to or homogeneously fused with the oblongated base.

16. The computer desk of claim 14 further comprising printer supporting means fixedly attached to or homogeneously fused with the oblongated base.

* * * * *